US007879192B2

(12) United States Patent
Smith et al.

(10) Patent No.: US 7,879,192 B2
(45) Date of Patent: Feb. 1, 2011

(54) MULTIPLY FORMER APPARATUS

(75) Inventors: James Smith, S. Beloit, IL (US); Gregory Welcher, S. Beloit, IL (US)

(73) Assignee: Paperchine Inc., Rockton, IL (US)

( * ) Notice: Subject to any disclaimer, the term of this patent is extended or adjusted under 35 U.S.C. 154(b) by 745 days.

(21) Appl. No.: 11/805,256

(22) Filed: May 22, 2007

(65) Prior Publication Data

US 2008/0000604 A1 Jan. 3, 2008

Related U.S. Application Data

(60) Provisional application No. 60/802,548, filed on May 22, 2006.

(51) Int. Cl.
*D21F 11/04* (2006.01)
*D21F 9/00* (2006.01)

(52) U.S. Cl. ..... 162/304; 162/132; 162/133; 162/303

(58) Field of Classification Search ..... 162/123, 162/132, 133, 203, 300, 303, 304
See application file for complete search history.

(56) References Cited

U.S. PATENT DOCUMENTS

| | | | | |
|---|---|---|---|---|
| 1,538,788 | A * | 5/1925 | Fish | 162/126 |
| 3,681,193 | A * | 8/1972 | Nykopp | 162/304 |
| 4,376,012 | A | 3/1983 | Bergstrom | |
| 4,753,710 | A | 6/1988 | Langley et al. | |
| 4,830,709 | A | 5/1989 | Turner et al. | |
| 4,913,775 | A | 4/1990 | Langley et al. | |
| 5,034,098 | A | 7/1991 | Hergert | |
| 5,064,502 | A | 11/1991 | Turner | |
| 5,427,654 | A | 6/1995 | Gray | |
| 5,468,348 | A | 11/1995 | Blackledge | |
| 5,584,967 | A | 12/1996 | Grossmann et al. | |
| 5,735,330 | A | 4/1998 | Buchmann et al. | |
| 6,159,341 | A | 12/2000 | Egelhof et al. | |
| 6,375,799 | B1 * | 4/2002 | Halmschlager et al. | 162/186 |
| 6,413,369 | B2 * | 7/2002 | Kinnunen | 162/130 |
| 6,616,811 | B2 * | 9/2003 | Wassermann et al. | 162/304 |
| 6,699,361 | B1 | 3/2004 | Leandersson et al. | |
| 6,702,926 | B1 | 3/2004 | Egelhof et al. | |
| 6,896,768 | B2 | 5/2005 | Dwiggins et al. | |
| 6,932,886 | B2 * | 8/2005 | Wassermann et al. | 162/129 |
| 7,037,406 | B2 | 5/2006 | Kershaw et al. | |
| 7,608,165 | B2 * | 10/2009 | Raisanen et al. | 162/132 |

FOREIGN PATENT DOCUMENTS

| | | |
|---|---|---|
| WO | WO 98/48111 | * 10/1998 |
| WO | WO 99/40256 | * 8/1999 |
| WO | WO 2005/078188 | * 8/2005 |

* cited by examiner

*Primary Examiner*—Eric Hug
(74) *Attorney, Agent, or Firm*—David J. Archer

(57) ABSTRACT

A multiply former apparatus is disclosed for forming a base, top and intermediate ply. The apparatus includes a fourdrinier wire for receiving thereon the base ply. A first twin wire former is provided for forming the intermediate ply, the first former cooperating with the fourdrinier wire. A second twin wire former forms the top ply, the second former cooperating with the fourdrinier wire. The second former includes a third looped wire which cooperates with a fourth looped wire for defining therebetween a second forming section for forming the top ply. A vacuum box is disposed upstream relative to a further vacuum device such that the fourth wire is disposed between the vacuum box and the third wire. The vacuum box assists in removing water from the second forming section for increasing a capacity of the apparatus.

17 Claims, 1 Drawing Sheet

MULTIPLY FORMER APPARATUS

CROSS REFERENCE TO RELATED APPLICATION

The present application is a Complete application to Provisional Patent application U.S. Ser. No. 60/802,548 filed May 22, 2006. All the disclosure of the aforementioned copending provisional application is incorporated herein by reference.

BACKGROUND OF THE INVENTION

1. Field of the Invention

The present invention relates to a multiply former apparatus.

More particularly the present invention relates to a multiply former apparatus for forming a base, top and intermediate ply.

2. Background Information

Wallboard and Gypsum board are produced for the building industry for the construction of walls and ceilings. The board on both outer surfaces thereof is provided with sheathing which is a multiply paper web.

More specifically, the multiply web is formed in a multiply former by uniting a base ply with an intermediate ply and a top ply so that the intermediate ply is disposed between the base and the top ply.

As the demand for the aforementioned building board continues to grow, there is a need to increase the rate at which such multiply web is produced. The present invention increases the capacity of a multiply former by more rapidly removing water from at least one of the formed plies.

Therefore, the primary feature of the present invention is the provision of a multiply forming apparatus that overcomes the problems associated with the prior art machines and which makes a significant contribution to the papermaking art.

Another feature of the present invention is the provision of a multiply forming apparatus that has an increased capacity.

Other features and advantages of the present invention will be readily apparent to those skilled in the art by a consideration of the detailed description of a preferred embodiment of the present invention contained herein.

SUMMARY OF THE INVENTION

The present invention relates to a multiply former apparatus for forming a base, top and intermediate ply. The apparatus includes a fourdrinier wire for receiving thereon the base ply. A first twin wire former is provided for forming the intermediate ply. The first former cooperates with the fourdrinier wire.

The first former includes a first looped wire which cooperates with a second looped wire for defining therebetween a first forming section for forming the intermediate ply. The first forming section has a first and a second end. A vacuum device is provided for urging the intermediate ply so that the intermediate ply predictably follows the first wire when the first and second wire extend away from each other adjacent to the second end of the first forming section. The first wire is disposed between the first forming section and the vacuum device. A combining roll guides the first wire from the second end of the first forming section so that the first wire is disposed between the combining roll and the first forming section. The combining roll urges the intermediate ply against the base ply which is supported by the fourdrinier wire. A second twin wire former forms the top ply, the second former cooperating with the fourdrinier wire.

The second former includes a third looped wire which cooperates with a fourth looped wire for defining therebetween a second forming section for forming the top ply. The second forming section has a first and a second extremity. A further vacuum device urges the top ply to follow the third wire when the third and fourth wire extend away from each other adjacent to the second extremity of the second forming section. The third wire is disposed between the second forming section and the further vacuum device. A further combining roll guides the third wire from the second extremity of the second forming section, the third wire being disposed between the further combining roll and the second forming section. The further combining roll urges the top ply against the intermediate ply which is supported by the fourdrinier wire such that the intermediate ply is disposed between the base and top plies. A vacuum box is disposed upstream relative to the further vacuum device such that the fourth wire is disposed between the vacuum box and the third wire. The vacuum box assists in removing water from the second forming section for increasing a capacity of the apparatus.

In a more specific embodiment of the present invention, the apparatus further includes a primary headbox which is disposed adjacent to the fourdrinier wire and upstream from the combining roll. The primary headbox ejects stock onto the fourdrinier wire such that the base ply is formed on the fourdrinier wire upstream relative to the combining roll.

The first twin wire former is disposed above the fourdrinier wire and includes a plurality of rolls disposed within the first looped wire for guiding the first looped wire. Also, a further plurality of rolls are disposed within the second looped wire for guiding the second looped wire such that the first forming section is curved.

Moreover, the curved first forming section runs approximately parallel to the fourdrinier wire adjacent to the first end of the first forming section. Also, the first forming section runs approximately normal to the fourdrinier wire adjacent to the second end of the first forming section such that as the intermediate ply guided between the first and second wires moves from the first towards the second end of the first forming section, the curved first forming section centifugally discharges water from the intermediate ply through the first wire.

Additionally, the vacuum device is a curved vacuum box for assisting removal of water through the first wire and for ensuring that the intermediate ply follows the first wire when the first and second wires extend away from each other downstream from the first forming section.

Also, the combining roll is disposed downstream relative to the vacuum device such that the intermediate ply supported beneath the first wire is urged by the combining roll against the base ply, the first wire being disposed between the combining roll and the intermediate ply.

The multiply former apparatus further includes a secondary headbox which is disposed upstream relative to the first end of the first forming section. The secondary headbox ejects stock onto the second wire such that the stock forms the intermediate ply during formation thereof along the first forming section.

Moreover, the second wire defines a preforming section disposed upstream relative to the first end of the first forming section.

Additionally, the preforming section has a first and a second extremity, the first extremity being disposed adjacent to the secondary headbox. The second extremity of the preforming section is disposed adjacent to the first end of the first forming section so that the stock is ejected from the secondary headbox substantially parallel to and in a same direction as the stock ejected from the primary headbox.

The second twin wire former is disposed above the fourdrinier wire and further includes a plurality of guide rolls disposed within the third looped wire for guiding the third looped wire. A further plurality of guide rolls are disposed within the fourth looped wire for guiding the fourth looped wire such that the second forming section is curved.

Also, the curved second forming section runs approximately parallel to the fourdrinier wire adjacent to the first extremity of the second forming section. The arrangement is such that as the top ply guided between the third and fourth wires moves from the first towards the second extremity of the second forming section, the curved second forming section centifugally discharges water from the top ply through the fourth wire.

The further vacuum device is a curved vacuum box for assisting removal of water through the third wire and for ensuring that the top ply follows the third wire when the third and fourth wires extend away from each other downstream from the second forming section.

Additionally, the further combining roll is disposed downstream relative to the further vacuum device such that the top ply supported beneath the third wire is urged by the further combining roll against the intermediate ply. The third wire is disposed between the further combining roll and the top ply.

The apparatus also includes a further secondary headbox which is disposed upstream relative to the first extremity of the second forming section. The further secondary headbox ejects stock onto the third wire such that the stock forms the top ply during formation thereof along the second forming section.

Also, the third wire defines a further preforming section which is disposed upstream relative to the first extremity of the second forming section.

The further preforming section has a first and a second end. The first end is disposed adjacent to the further secondary headbox and the second end of the further preforming section is disposed adjacent to the first extremity of the second forming section. The arrangement is such that the stock is ejected from the further secondary headbox substantially parallel to and in an opposite direction to the direction of stock ejected from the primary headbox.

Furthermore, the vacuum box is disposed within the fourth looped wire and assists in removing water discharged centrifugally through the fourth wire so that the capacity of the apparatus is increased and for increasing drainage of water from stock guided between the third and fourth wires.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWING

The drawing is a side elevational view of a multiply forming apparatus according to the present invention.

DETAILED DESCRIPTION OF THE DRAWING

Figure 1:
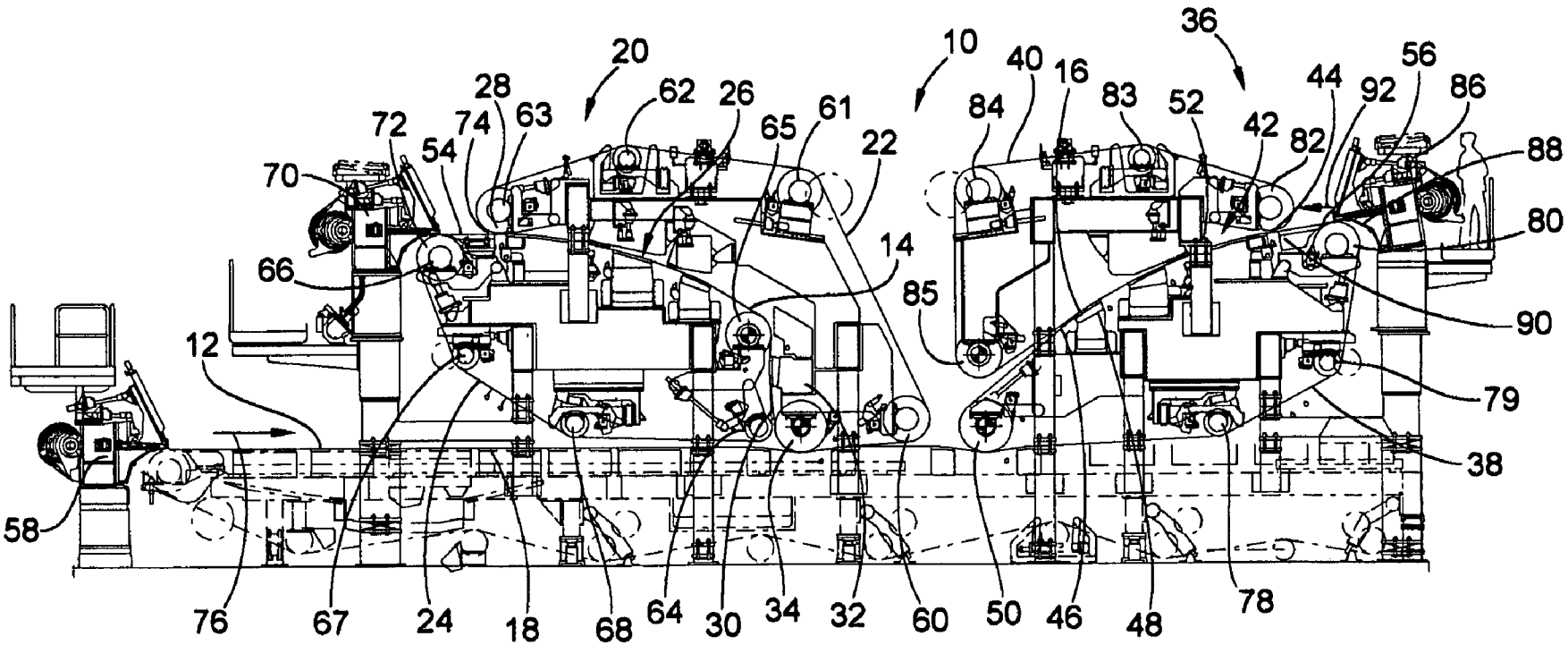

The attached drawing is a side elevational view of a multiply former apparatus generally designated 10 for forming a base, intermediate and top ply 12, 14 and 16 respectively. The apparatus 10 includes a fourdrinier wire 18 for receiving thereon the base ply 12. A first twin wire former generally designated 20 is provided for forming the intermediate ply 14, the first former 20 cooperating with the fourdrinier wire 18.

The first former 20 includes a first looped wire 22 which cooperates with a second looped wire 24 for defining therebetween a first forming section generally designated 26 for forming the intermediate ply 14. The first forming section 26 has a first and a second end 28 and 30 respectively. A vacuum device 32 is provided for urging the intermediate ply 14 to follow the first wire 22 when the first and second wire 22 and 24 extend away from each other adjacent to the second end 30 of the first forming section 26. As shown in the drawing, the first wire 22 is disposed between the first forming section 26 and the vacuum device 32. A combining roll 34 guides the first wire 22 from the second end 30 of the first forming section 26. The first wire 22 is disposed between the combining roll 34 and the first forming section 26. The combining roll 34 urges the intermediate ply 14 against the base ply 12 which is supported by the fourdrinier wire 18. A second twin wire former generally designated 36 forms the top ply 16 with the second former 36 cooperating with the fourdrinier wire 18.

The second former 36 includes a third looped wire 38 which cooperates with a fourth looped wire 40 for defining therebetween a second forming section 42 for forming the top ply 16. The second forming section 42 has a first and a second extremity 44 and 46 respectively. A further vacuum device 48 urges the top ply 16 to follow the third wire 38 when the third and fourth wire 38 and 40 extend away from each other adjacent to the second extremity 46 of the second forming section 42. The third wire 38 is disposed between the second forming section 42 and the further vacuum device 48. A further combining roll 50 guides the third wire 38 from the second extremity 46 of the second forming section 42. The third wire 38 is disposed between the further combining roll 50 and the second forming section 42. The further combining roll 50 urges the top ply 16 against the intermediate ply 14 which is supported by the fourdrinier wire 18 such that the intermediate ply 14 is disposed between the base and top plies 12 and 16. A vacuum box 52 is disposed upstream relative to the further vacuum device 48 such that the fourth wire 40 is disposed between the vacuum box 52 and the third wire 38. The vacuum box 52 assists in removing water from the second forming section 42 for increasing the capacity of the apparatus 10.

In a more specific embodiment of the present invention, the apparatus 10 further includes a primary headbox 58 which is disposed adjacent to the fourdrinier wire 18 and upstream from the combining roll 34. The primary headbox 58 ejects stock onto the fourdrinier wire 18 such that the base ply 12 is formed on the fourdrinier wire 18 upstream relative to the combining roll 34.

As shown in the drawing, the first twin wire former 20 is disposed above the fourdrinier wire 18 and includes a plurality of rolls 60, 61, 62, 63 and 34 disposed within the first looped wire 22 for guiding the first looped wire 22. Also, a further plurality of rolls 64, 65, 66, 67 and 68 are disposed within the second looped wire 24 for guiding the second looped wire 24 such that the first forming section 26 is curved.

Moreover, the curved first forming section 26 runs approximately parallel to the fourdrinier wire 18 adjacent to the first end 28 of the first forming section 26. Also, the first forming section 26 runs approximately normal to the fourdrinier wire 18 adjacent to the second end 30 of the first forming section 26 such that as the intermediate ply 14 guided between the first and second wires 22 and 24 moves from the first towards the second end 28 and 30 respectively of the first forming section 26, the curved first forming section 26 centifugally discharges water from the intermediate ply 14 through the first wire 22.

Additionally, the vacuum device 32 is a curved vacuum box for assisting removal of water through the first wire 22 and for ensuring that the intermediate ply 14 follows the first wire 22 when the first and second wires 22 and 24 extend away from each other downstream from the first forming section 26.

Also, the combining roll 34 is disposed downstream relative to the vacuum device 32 such that the intermediate ply 14 supported beneath the first wire 22 is urged by the combining roll 34 against the base ply 12. The first wire 22 as shown in the drawing is disposed between the combining roll 34 and the intermediate ply 14.

The multiply former apparatus 10 further includes a secondary headbox 70 which is disposed upstream relative to the first end 28 of the first forming section 26. The secondary headbox 70 ejects stock onto the second wire 24 such that the stock forms the intermediate ply 14 during formation thereof along the first forming section 26.

Moreover, the second wire 24 defines a preforming section 54 disposed upstream relative to the first end 28 of the first forming section 26.

Additionally, the preforming section 54 has a first and a second extremity 72 and 74 respectively, the first extremity 72 being disposed adjacent to the secondary headbox 70. The second extremity 74 of the preforming section 54 is disposed adjacent to the first end 28 of the first forming section 26 so that the stock is ejected from the secondary headbox 70 substantially parallel to and in a same direction, as indicated by the arrow 76, as the stock ejected from the primary headbox 58.

The second twin wire former 36 is disposed above the fourdrinier wire 18 and includes a plurality of guide rolls 78, 79, 80 and 50 disposed within the third looped wire 38 for guiding the third looped wire 38. A further plurality of guide rolls 82, 83, 84 and 85 are disposed within the fourth looped wire 40 for guiding the fourth looped wire 40 such that the second forming section 42 is curved.

Also, the curved second forming section 42 runs approximately parallel to the fourdrinier wire 18 adjacent to the first extremity 44 of the second forming section 42. The arrangement is such that as the top ply 16 guided between the third and fourth wires 38 and 40 respectively moves from the first towards the second extremity 44 and 46 respectively of the second forming section 42, the curved second forming section 42 centifugally discharges water from the top ply 16 through the fourth wire 40.

The further vacuum device 48 is a curved vacuum box for assisting removal of water through the third wire 38 and for ensuring that the top ply 16 follows the third wire 38 when the third and fourth wires 38 and 40 respectively extend away from each other downstream from the second forming section 42.

Additionally, the further combining roll 50 is disposed downstream relative to the further vacuum device 48 such that the top ply 16 supported beneath the third wire 38 is urged by the further combining roll 50 against the intermediate ply 14. The third wire 38 is disposed between the further combining roll 50 and the top ply 16.

The apparatus 10 also includes a further secondary headbox 86 which is disposed upstream relative to the first extremity 44 of the second forming section 42. The further secondary headbox 86 ejects stock onto the third wire 38 such that the stock forms the top ply 16 during formation thereof along the second forming section 42.

Also, the third wire 38 defines a further preforming section 56 which is disposed upstream relative to the first extremity 44 of the second forming section 42.

The further preforming section 56 has a first and a second end 88 and 90 respectively. The first end 88 is disposed adjacent to the further secondary headbox 86 and the second end 90 of the further preforming section 56 is disposed adjacent to the first extremity 44 of the second forming section 42. The arrangement is such that the stock is ejected from the further secondary headbox 86 substantially parallel to and in an opposite direction, as indicated by the arrow 92, to the direction 76 of stock ejected from the primary headbox 58.

Furthermore, the vacuum box 52 is disposed within the fourth looped wire 40 and assists in removing water discharged centrifugally through the fourth wire 40 so that the capacity of the apparatus 10 is increased. More particularly, the vacuum box 52 increases the drainage of water from stock guided between the third and fourth wires 38 and 40 respectively.

The apparatus according to the present invention has a flat preforming section 54 which is disposed upstream from the first forming section 26. Also, the apparatus 10 has a further flat preforming section 56 which is disposed upstream from the second forming section 42.

Additionally, the vacuum box 52 is an inverted vacuum box for extracting water from the top ply 16 through the fourth wire 40.

Furthermore, both the first and second forming sections 26 and 42 may be provided with counter blades for enhancing the removal of water through the respective wires of the forming sections 26 and 42. The counterblades may be secured opposite to the vacuum box 52.

In operation of the apparatus shown in the drawing, a base ply is formed on the fourdrinier wire 18 and progresses in the direction of the arrow 76. The intermediate ply is formed between the wires 22 and 24 of the first twin wire former 20, the intermediate ply 14 initially moving in parallel spaced relationship to the base ply and in the same direction 76 thereto. The combining roll 34 unites the intermediate ply onto the base ply 12 so that the combined base and intermediate plies move in the same direction 76. The top ply is formed between the wires 38 and 40 and initially moves in a direction 92 which is opposite to the direction of movement 76 of the combined base and intermediate plies 12 and 14. However, the further combining roll 50 presses the top ply 16 against the intermediate ply 14 so that the united base, intermediate and top plies 12, 14 and 16 supported on the fourdrinier wire 18 move in the direction 76 towards a downstream press section (not shown).

The present invention provides a unique configuration for a multiply forming apparatus that increases the capacity compared with prior art proposals.

What is claimed is:

1. A multiply former apparatus for forming a base, top and intermediate ply, said apparatus comprising:

a fourdrinier wire for receiving thereon the base ply;

a first twin wire former for forming the intermediate ply, said first former cooperating with said fourdrinier wire;

said first former including:

a first looped wire cooperating with a second looped wire for defining therebetween a first forming section for forming the intermediate ply, said first forming section having a first and a second end;

a vacuum device for urging the intermediate ply to follow said first wire when said first and second wire extend away from each other adjacent to said second end of said first forming section, said first wire being disposed between said first forming section and said vacuum device;

a combining roll for guiding said first wire from said second end of said first forming section, said first wire being disposed between said combining roll and said first forming section, said combining roll urging the intermediate ply against the base ply supported by the fourdrinier wire;

a second twin wire former for forming the top ply, said second former cooperating with said fourdrinier wire;

said second former including:

a third looped wire cooperating with a fourth looped wire for defining therebetween a second forming section for forming the top ply, said second forming section having a first and a second extremity;

a further vacuum device for urging the top ply to follow said third wire when said third and fourth wire extend away from each other adjacent to said second extremity of said second forming section, said third wire being disposed between said second forming section and said further vacuum device;

a further combining roll for guiding said third wire from said second extremity of said second forming section, said third wire being disposed between said further combining roll and said second forming section, said further combining roll urging the top ply against the intermediate ply supported by the fourdrinier wire such that the intermediate ply is disposed between said base and top plies;

a vacuum box disposed upstream relative to said further vacuum device such that said fourth wire is disposed between said vacuum box and said third wire, said vacuum box assisting in removing water from said second forming section for increasing a capacity of the apparatus;

a primary headbox disposed adjacent to said fourdrinier wire and upstream from said combining roll, said primary headbox ejecting stock onto said fourdrinier wire such that the base ply is formed on said fourdrinier wire upstream relative to said combining roll;

a secondary headbox disposed upstream relative to said first end of said first forming section, said secondary headbox ejecting stock onto said second wire such that the stock forms the intermediate ply during formation thereof along said first forming section; and said second wire defining a preforming section upstream relative to said first end of said first forming section.

2. A multiply former apparatus as set forth in claim 1 wherein said first twin wire former is disposed above said fourdrinier wire.

3. A multiply former apparatus as set forth in claim 1 further including:

a plurality of rolls disposed within said first looped wire for guiding said first looped wire;

a further plurality of rolls disposed within said second looped wire for guiding said second looped wire such that said first forming section is curved.

4. A multiply former apparatus as set forth in claim 3 wherein said curved first forming section runs approximately parallel to said fourdrinier wire adjacent to said first end of said first forming section, said first forming section running approximately normal to said fourdrinier wire adjacent to said second end of said first forming section such that as the intermediate ply guided between said first and second wires moves from said first towards said second end of said first forming section, said curved first forming section centifugally discharges water from said intermediate ply through said first wire.

5. A multiply former apparatus as set forth in claim 1 wherein said vacuum device is a curved vacuum box for assisting removal of water through said first wire and for ensuring that the intermediate ply follows said first wire when said first and second wires extend away from each other downstream from said first forming section.

6. A multiply former apparatus as set forth in claim 1 wherein said combining roll is disposed downstream relative to said vacuum device such that the intermediate ply supported beneath said first wire is urged by said combining roll against the base ply, said first wire being disposed between said combining roll and the intermediate ply.

7. A multiply former apparatus as set forth in claim 1 wherein said preforming section has a first and a second extremity, said first extremity being disposed adjacent to said secondary headbox, said second extremity of said preforming section being disposed adjacent to said first end of said first forming section so that the stock is ejected from said secondary headbox substantially parallel to and in a same direction as the stock ejected from said primary headbox.

8. A multiply former apparatus as set forth in claim 1 wherein said second twin wire former is disposed above said fourdrinier wire.

9. A multiply former apparatus as set forth in claim 1 further including:

a plurality of guide rolls disposed within said third looped wire for guiding said third looped wire;

a further plurality of guide rolls disposed within said fourth looped wire for guiding said fourth looped wire such that said second forming section is curved.

10. A multiply former apparatus as set forth in claim 9 wherein said curved second forming section runs approximately parallel to said fourdrinier wire adjacent to said first extremity of said second forming section, such that as the top ply guided between said third and fourth wires moves from said first towards said second extremity of said second forming section, said curved second forming section centifugally discharges water from said top ply through said fourth wire.

11. A multiply former apparatus as set forth in claim 1 wherein said further vacuum device is a curved vacuum box for assisting removal of water through said third wire and for ensuring that the top ply follows said third wire when said third and fourth wires extend away from each other downstream from said second forming section.

12. A multiply former apparatus as set forth in claim 1 wherein said further combining roll is disposed downstream relative to said further vacuum device such that the top ply supported beneath said third wire is urged by said further combining roll against the intermediate ply, said third wire being disposed between said further combining roll and the top ply.

13. A multiply former apparatus as set forth in claim 1 further including:

a further secondary headbox disposed upstream relative to said first extremity of said second forming section, said further secondary headbox ejecting stock onto said third wire such that the stock forms the top ply during formation thereof along said second forming section.

14. A multiply former apparatus as set forth in claim 1 wherein said vacuum box disposed within said fourth looped wire assists in removing water discharged centrifugally through said fourth wire so that the capacity of the apparatus is increased and for increasing drainage of water from stock guided between said third and fourth wires.

15. A multiply former apparatus for forming a base, top and intermediate ply, said apparatus comprising:

a fourdrinier wire for receiving thereon the base ply;

a first twin wire former for forming the intermediate ply, said first former cooperating with said fourdrinier wire;

said first former including:

a first looped wire cooperating with a second looped wire for defining therebetween a first forming section for forming the intermediate ply, said first forming section having a first and a second end;

a vacuum device for urging the intermediate ply to follow said first wire when said first and second wire extend away from each other adjacent to said second end of said first forming section, said first wire being disposed between said first forming section and said vacuum device;

a combining roll for guiding said first wire from said second end of said first forming section, said first wire being disposed between said combining roll and said first forming section, said combining roll urging the intermediate ply against the base ply supported by the fourdrinier wire;

a second twin wire former for forming the top ply, said second former cooperating with said fourdrinier wire;

said second former including:

a third looped wire cooperating with a fourth looped wire for defining therebetween a second forming section for forming the top ply, said second forming section having a first and a second extremity;

a further vacuum device for urging the top ply to follow said third wire when said third and fourth wire extend away from each other adjacent to said second extremity of said second forming section, said third wire being disposed between said second forming section and said further vacuum device;

a further combining roll for guiding said third wire from said second extremity of said second forming section, said third wire being disposed between said further combining roll and said second forming section, said further combining roll urging the top ply against the intermediate ply supported by the fourdrinier wire such that the intermediate ply is disposed between said base and top plies;

a vacuum box disposed upstream relative to said further vacuum device such that said fourth wire is disposed between said vacuum box and said third wire, said vacuum box assisting in removing water from said second forming section for increasing a capacity of the apparatus;

a primary headbox disposed adjacent to said fourdrinier wire and upstream from said combining roll, said primary headbox ejecting stock onto said fourdrinier wire such that the base ply is formed on said fourdrinier wire upstream relative to said combining roll;

a further secondary headbox disposed upstream relative to said first extremity of said second forming section, said further secondary headbox ejecting stock onto said third wire such that the stock forms the top ply during formation thereof along said second forming section; and said third wire defining a further preforming section disposed upstream relative to said first extremity of said second forming section.

16. A multiply former apparatus as set forth in claim 15 wherein said further preforming section has a first and a second end, said first end being disposed adjacent to said further secondary headbox, said second end of said further preforming section being disposed adjacent to said first extremity of said second forming section so that the stock is ejected from said further secondary headbox substantially parallel to and in an opposite direction to the direction of stock ejected from said primary headbox.

17. A multiply former apparatus for forming a base, top and intermediate ply, said apparatus comprising:

a fourdrinier wire for receiving thereon the base ply;

a first twin wire former for forming the intermediate ply, said first former cooperating with said fourdrinier wire;

said first former including:

a first looped wire cooperating with a second looped wire for defusing therebetween a first forming section for forming the intermediate ply, said first forming section having a first and a second end;

a vacuum device for urging the intermediate ply to follow said first wire when said first and second wire extend away from each other adjacent to said second end of said first forming section, said first wire being disposed between said first forming section and said vacuum device;

a combining roll for guiding said first wire from said second end of said first forming section, said first wire being disposed between said combining roll and said first forming section, said combining roll urging the intermediate ply against the base ply supported by the fourdrinier wire;

a second twin wire former for forming the top ply, said second former cooperating with said fourdrinier wire;

said second former including:

a third looped wire cooperating with a fourth looped wire for defining therebetween a second forming section for forming the top ply, said second forming section having a first and a second extremity;

a further vacuum device for urging the top ply to follow said third wire when said third and fourth wire extend away from each other adjacent to said second extremity of said second forming section, said third wire being disposed between said second forming section and said further vacuum device;

a further combining roll for guiding said third wire from said second extremity of said second forming section, said third wire being disposed between said further combining roll and said second forming section, said further combining roll urging the top ply against the intermediate ply supported by the fourdrinier wire such that the intermediate ply is disposed between said base and top plies;

a vacuum box disposed upstream relative to said further vacuum device such that said fourth wire is disposed between said vacuum box and said third wire, said vacuum box assisting in removing water from said second forming section for increasing a capacity of the apparatus;

a primary headbox disposed adjacent to said fourdrinier wire and upstream from said combining roll;

said primary headbox ejecting stock onto said fourdrinier wire such that the base ply is formed on said fourdrinier wire upstream relative to said combining roll;

said first twin wire former being disposed above said fourdrinier wire;

a plurality of rolls disposed within said first looped wire for guiding said first looped wire;

a further plurality of rolls disposed within said second looped wire for guiding said second looped wire such that said first forming section is curved;

said curved first forming section running approximately parallel to said fourdrinier wire adjacent to said first end of said first forming section, said first forming section running approximately normal to said fourdrinier wire adjacent to said second end of said first forming section such that as the intermediate ply guided between said first and second wires moves from said first towards said second end of said first forming section, said curved first forming section centifugally discharges water from said intermediate ply through said first wire;

said vacuum device being a curved vacuum box for assisting removal of water through said first wire and for ensuring that the intermediate ply follows said first wire when said first and second wires extend away from each other downstream from said first forming section;

said combining roll being disposed downstream relative to said vacuum device such that the intermediate ply supported beneath said first wire is urged by said combining roll against the base ply, said first wire being disposed between said combining roll and the intermediate ply;

a secondary headbox disposed upstream relative to said first end of said first forming section, said secondary headbox ejecting stock onto said second wire such that the stock forms the intermediate ply during formation thereof along said first forming section;

said second wire defining a preforming section upstream relative to said first end of said first forming section;

said preforming section having a first and a second extremity, said first extremity being disposed adjacent to said secondary headbox, said second extremity of said preforming section being disposed adjacent to said first end of said first forming section so that the stock is ejected from said secondary headbox substantially parallel to and in a same direction as the stock ejected from said primary headbox;

said second twin wire former being disposed above said fourdrinier wire;

a plurality of guide rolls disposed within said third looped wire for guiding said third looped wire;

a further plurality of guide rolls disposed within said fourth looped wire for guiding said fourth looped wire such that said second forming section is curved;

said curved second forming section running approximately parallel to said fourdrinier wire adjacent to said first extremity of said second forming section, such that as the top ply guided between said third and fourth wires moves from said first towards said second extremity of said second forming section, said curved second forming section centifugally discharges water from said top ply through said fourth wire;

said further vacuum device being a curved vacuum box for assisting removal of water through said third wire and for ensuring that the top ply follows said third wire when said third and fourth wires extend away from each other downstream from said second forming section;

said further combining roll being disposed downstream relative to said further vacuum device such that the top ply supported beneath said third wire is urged by said further combining roll against the intermediate ply, said third wire being disposed between said further combining roll and the top ply;

a further secondary headbox disposed upstream relative to said first extremity of said second forming section, said further secondary headbox ejecting stock onto said third wire such that the stock forms the top ply during formation thereof along said second forming section;

said third wire defining a further preforming section disposed upstream relative to said first extremity of said second forming section;

said further preforming section having a first and a second end, said first end being disposed adjacent to said further secondary headbox, said second end of said further preforming section being disposed adjacent to said first extremity of said second forming section so that the stock is ejected from said further secondary headbox substantially parallel to and in an opposite direction to the direction of stock ejected from said primary headbox; and said vacuum box disposed within said fourth looped wire assisting in removing water discharged centrifugally through said fourth wire so that the capacity of the apparatus is increased and for increasing drainage of water from stock guided between said third and fourth wires.

* * * * *